US005947183A

United States Patent [19]

Schneider et al.

[11] Patent Number: 5,947,183

[45] Date of Patent: Sep. 7, 1999

[54] CONTINUOUS CASTING APPARATUS

[75] Inventors: Wolfgang Schneider, St. Augustin; Werner Droste, Bonn, both of Germany

[73] Assignee: VAW Aluminium AG, Bonn, Germany

[21] Appl. No.: 08/206,743

[22] Filed: Mar. 4, 1994

[30] Foreign Application Priority Data

Mar. 5, 1993 [DE] Germany ..... 43 06 943

[51] Int. Cl.[6] ..... B22D 11/08

[52] U.S. Cl. ..... 164/425; 164/445

[58] Field of Search ..... 164/425, 426, 164/445, 446, 483

[56] References Cited

U.S. PATENT DOCUMENTS

| | | | |
|---|---|---|---|
| 3,384,152 | 5/1968 | Olsen et al. | 164/425 |
| 3,620,285 | 11/1971 | Olsson | 164/425 |
| 3,702,152 | 11/1972 | Bryson | 164/425 X |
| 3,702,631 | 11/1972 | Sergerie | 164/425 |
| 3,780,789 | 12/1973 | Unger | 164/425 X |
| 4,509,580 | 4/1985 | Goodrich | 164/425 X |
| 5,217,060 | 6/1993 | Lazzaro | 164/425 |

FOREIGN PATENT DOCUMENTS

| | | | |
|---|---|---|---|
| 2081897 | 12/1971 | France . | |
| 810062 | 8/1951 | Germany . | |
| 62-9747 | 1/1987 | Japan | 164/418 |
| 4-270035 | 9/1992 | Japan | 164/445 |
| 5-50186 | 3/1993 | Japan | 164/445 |
| 1764789 | 9/1992 | U.S.S.R. | 164/426 |
| 2029295 | 3/1980 | United Kingdom | 164/445 |
| 2034216 | 6/1988 | United Kingdom . | |

OTHER PUBLICATIONS

Patent Abstracts of Japan, vol. 011, No. 021, Jan. 21, 1987 & JP 61–195757 Published Aug. 30, 1986.

Translation of Japanese Kokai Patent Application 5–50186 Published Mar. 2, 1993.

*Primary Examiner*—J. Reed Batten, Jr.

*Attorney, Agent, or Firm*—Perman & Green, LLP

[57] ABSTRACT

The apparatus has a starter bar of novel design which avoids the problems of deformation of the billet base, loss and waste of casting metal and loss of billet stability. The apparatus includes a tub-like having a peripheral wall and a central raised element or cone having tapered outer surfaces, to stabilize the base of the billet during casting and to dislodge the cooled billet as it shrinks.

27 Claims, 15 Drawing Sheets

CONTINUOUS CASTING APPARATUS

FIELD OF THE INVENTION

The invention relates to a continuous casting apparatus for billets or bars to be rolled, consisting of a mould having a shaping attachment and a die which closes or seals the mould at the lower end in the starting condition and which receives the metal melt from the shaping attachment in the vertical direction.

BACKGROUND OF THE INVENTION

Vertical continuous casting devices of the aforementioned type are known, for example, from the Aluminum-Taschenbuch, 14th edition, p.22 ff. The mould consists of a low, water-cooled ring or annular mold cavity enclosure which, before casting begins, is closed by a base piece or die secured to the lowerable casting table. The metal flows in from the furnace at a low temperature through a channel into the die and, when it begins to solidify, the table is lowered and the emerging billet or bar is cooled directly by being sprayed with water. Reference is also made to U.S. Pat. Nos. 4,157,728 and 5,170,838.

When the lower edge of the cast billet reaches the region of secondary cooling, the corners of the billet base shrink and deform or curve upwardly away from the die. The extent of such deformation increases as a function of the side ratio and the shape of the billet. As a result of such deformation, the billet loses some of its stability on the die. Water runs into the gap between the die and the billet, evaporates and leads to "bumping". As a result of its reduced stability, the billet may wobble and become lopsided. Furthermore, the gap causes the thermal contact between the die and the lower end of the billet to be lost.

Under unfavorable conditions, the billet may melt or break open at its lower end, and metal may flow out, which, from a safety point of view, leads to a critical casting situation. Furthermore, as a result of the deformation on the narrower side of the billet in the mould, the surface layer which had formed there is lifted off the cooling running face of the mould, surface layer growth is disturbed and, under disadvantageous conditions, the surface layer may break open and melt, with melt then moving downwards and escaping. This may lead to a critical or dangerous casting situation and so-called icicles adversely affecting further processing of the billet may form on the narrower side of the billet. Said billet base deformation also increases the amount of billet base scrap, i.e. the part of the billet which has to be sawn off the lower end of the billet. Deformation is usually asymmetric, which further increases the amount of billet base scrap and the likelihood of the above defects occurring.

There exists a number of prior art measures attempting to reduce stresses in the billet base when casting begins, and thus the amount of billet base deformation.

A. T. Taylor et al. (Metal Progress, 1957, pp 70–74) have used compressed air to reduce the effect of secondary cooling when casting begins and thus to reduce the stress build-up in the case of billets having large dimensions.

N. B. Bryson (Canadian Metallurgical Quarterly, 7, 1968, pp 55–59) proposes so-called pulse water cooling wherein, during the initial casting phase, the flow of cooling water is periodically interrupted. As a result, the billet surface may temporarily reheat and cooling stresses are not built up to the same extent, so that the extent of billet base deformation is reduced. In large systems, said method requires expensive, rapidly acting valves to enable the cooling water to be switched on and off quickly.

Furthermore, the rapid switching action may induce severe overloading in the-power lines.

H. Yu (Light Metals, AIME Proceedings, 1980, pp 613 628) attempts to influence the actual cooling process by dissolving gases, preferably $CO_2$, in water. When hitting the hot billet, the gas forms a thin insulating steam layer which reduces the rate of cooling, thus reducing the stress build-up and billet base deformation. However, the solubility of $CO_2$ in water greatly depends on the starting temperature and the composition of the water. A specific adjustment of the cooling effect i.e. metering the amount of $CO_2$ to suit the water quality can only be achieved by expensive measuring processes.

F. E. Wagstaff (U.S. Pat. No. 4,693,298) makes a similar proposal by suggesting that shortly before hitting the billet, the cooling water should be mixed with air while still in the mould. The air bubbles in the water are intended to function in the same way as the dissolved $CO_2$. This method is known under the name of TurboCRT (Curl Reduction Technology). As far as the specific adjustment of the cooling effect as a function of water quality is concerned, it is subject to similar restrictions as the $CO_2$ —method. Furthermore, distributing the air uniformly in the water presents a problem.

All the above methods when applied under practical casting conditions require a great deal of sophisticated technical equipment. Furthermore, they cause a considerable amount of additional maintenance expenditure and additional costs for providing $CO_2$, and further costs result from the provision and consumption of energy for the purpose of generating compressed air.

SUMMARY OF THE INVENTION

The present invention provides an improved continuous casting apparatus for billets to be rolled, which provides increased safety during the initial casting phase, improved billet stability and greatly reduced occurrence of billet base deformation and billet base scrap.

Numerous tests have shown that the extent of billet deformation occurring during the initial casting phase is directly related to the deformation speed at the onset of deformation. It is not only a question of increasing the heat content by deepening the die and by providing a larger amount of melt in the billet base region during the initial casting phase, but also of providing a specific measure for reducing stresses while the billet base is cooling. It has been found that by increasing the stiffness of the solidified surface layer in the die, the rate of deformation can be reduced considerably. To achieve good repeatable results, it is important to achieve an accurate die geometry and the right relationship between the dimensions of the indentation and the shape of the die.

In accordance with the present invention, inclined faces are provided between the continuous edge or peripheral wall of the die and raised central portions of the die to ensure that during the initial casting phase, in the die, there first solidifies a kind of box or rectangular base portion with several relatively high, steeply upwardly extending walls which, for mechanical reasons, stiffen the billet base. The greater the height h of the wall or indentation, the higher the degree of mechanical stiffening at the billet base. This means that, during continuous casting in the initial casting phase, the billet base deforms more slowly and that, overall, there is less deformation.

By providing a central raised portion of the die with a substantially trapezoidal cross-section according to the present invention, it is possible, on the one hand, to provide the billet with an initial support, and on the other hand, the force required at the end of the casting process for lifting or releasing the billet out of the die is greatly reduced as a result of the conical tapered shape of the central raised portion as compared to the rectangular cross-section of the raised wall portion. The combination of these two advantages clearly improves the production of billets on a continuous casting apparatus in accordance with the invention.

By skillfully designing the tapered side faces of the raised central portion(s) of the die, for example by providing them with ripples or by continuously changing the angles thereof, it is possible favorably to affect the heat flow from the melt into the die; the solidifying billet cools satisfactorily and this is combined with a high degree of heat dissipation. The raised central portion is cooled from inside or it consists of an insert formfittingly inserted into a recess in the floor or base of the die. In a preferred embodiment, the insert consists of a copper alloy which is characterized by particularly advantageous heat transfer properties.

If, in spite of these measures, because of the position of the raised portion which is disadvantageous from the point of view of heat flow and cooling and exposed from the point of view of thermal loads, the supply of melt threatens to cause damage to the raised portion when filling the mould, it is advisable to provide the raised portion with a protection coating or facing, either entirely or partially. It is also possible to reduce the area of the flat upper end of the raised portion pointing towards the melt inlet and, by means of roof-like facets or tapered extensions, lead it into the side walls towards the indentation or well.

In addition to providing internal cooling, the cooling water flowing out of the mould may be collected by guiding plates at the base of the die and drained into cooling bores within the die. This embodiment constitutes a particularly simple and safe device for cooling the die.

THE DRAWINGS

DETAIL DESCRIPTION

Figure 1C:
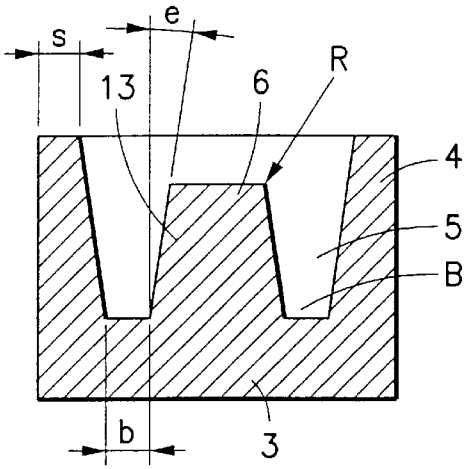
FIG. 1 illustrate a plan view A and longitudinal cross-section B and a lateral cross-section C of a die in accordance with an embodiment of the present invention.
Figure 1B:
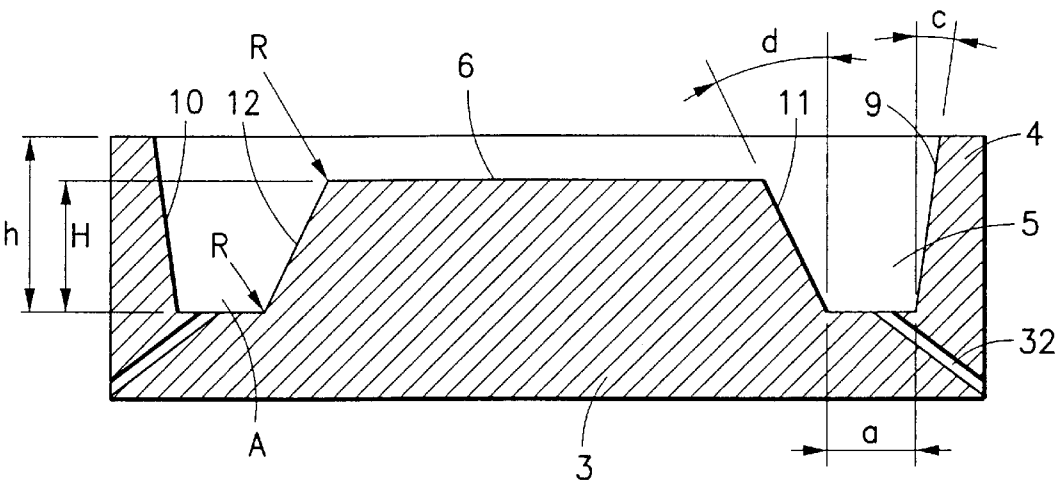
Figure 1A:
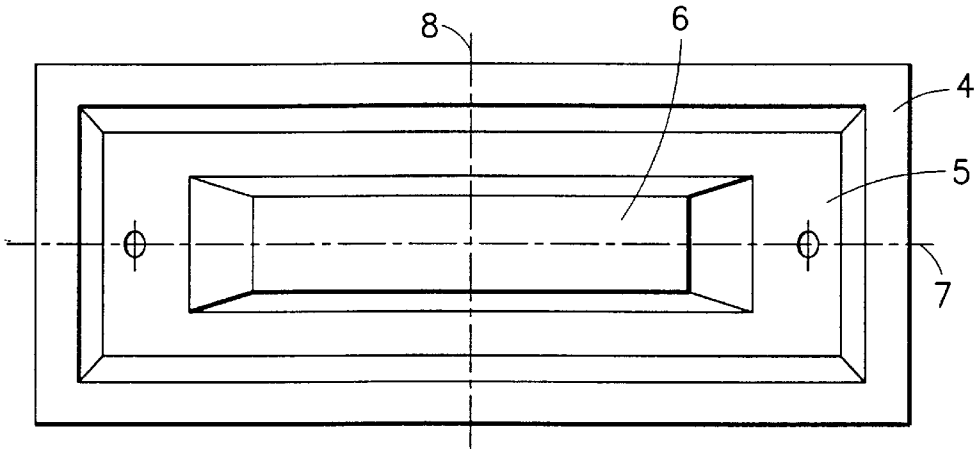

FIG. 1 illustrates a starter block or stool, hereinafter referred to as a die in accordance with an embodiment of the present invention, in a plan view A and in vertical cross sections B, C. The die 3 comprises a tub having a continuous peripheral wall 4 having an inner surface which is inclined towards a recessed peripheral well portion 5. The angle of inclination amounts to C=0–30° and the height of the continuous wall 4, h=60–220 mm. For example in the case of a 600 mm×200 mm billet, the well portion 5 in accordance with the invention has a depth (h) of 80 mm, whereas with a 2200 mm×600 mm or 1050 mm×600 mm billet the well depth (h) may be 140 mm±40 mm. The width S of the continuous wall 4 is preferably 5–40 mm.

The cone or raised central portion 6 rising from and surrounded by the well portion 5 is positioned symmetrically relative to the central axes 7, 8 of the die in accordance with the invention. When viewed in cross-sections B and C, the raised portion 6 consists of a trapezoidal truncated cone comprising inclined end faces 11 and 12, and side faces 13. The angle of inclination of the end faces 11 and 12 ranges between 30° and 60° (angle d), whereas the angle of inclination of the side faces (13) ranges between 30° and 36° (angle e) as measured relative to perpendicular.

The distances between the peripheral wall 4 and the raised central portion 6 at the base of the well 5 range between 0–200 mm, with the width A at the narrower sides or ends preferably being 100 to 150 mm and the width B at the longer sides of the die preferably being 30 to 100 mm. Furthermore, the base of the well 5 is provided with drainage channels 32 for draining the cooling water flowing into the well 5.

Figure 4C:
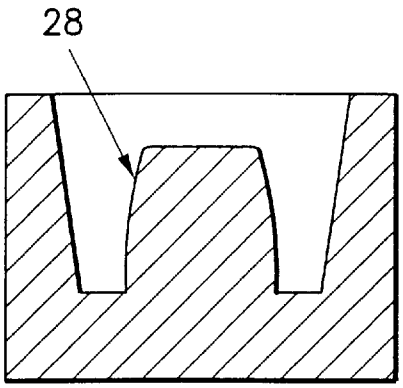
FIG. 4 illustrates a plan view A and cross-sections B and C of a die in accordance with another embodiment of the invention, according to FIG. 3, having a spherical or rounded side face on an elliptical central raised area.
Figure 4B:
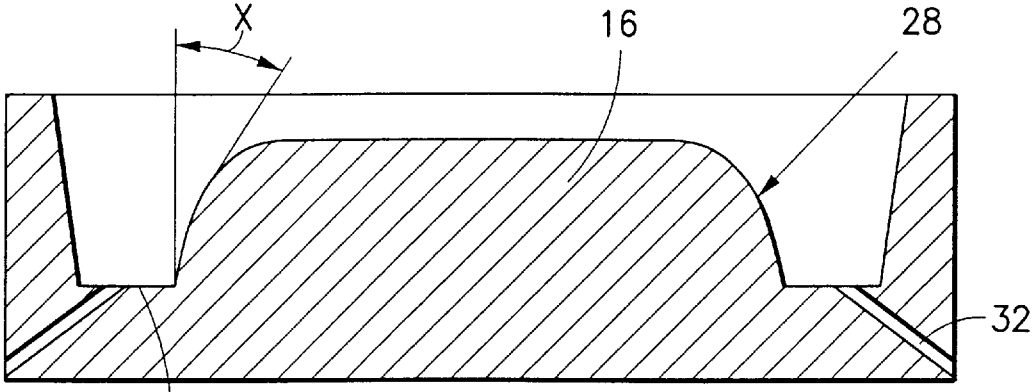
Figure 4A:
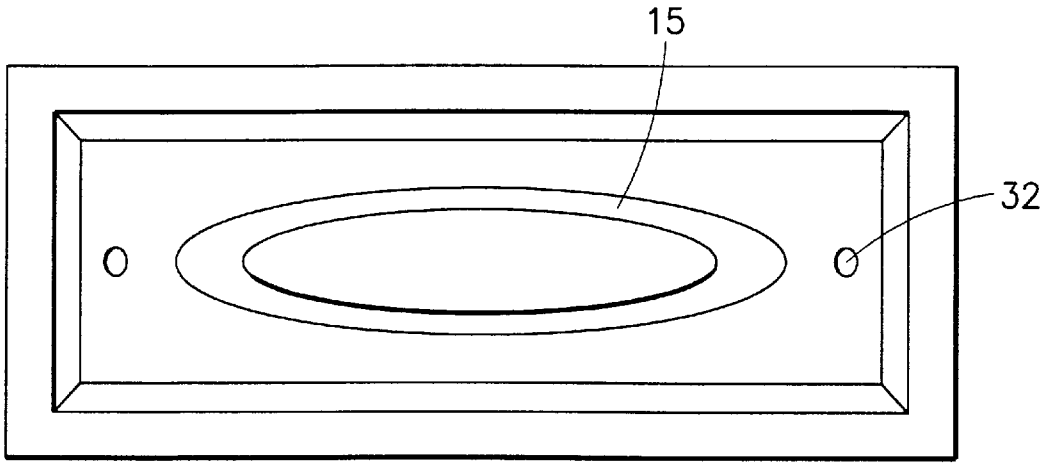

Height H of the raised central portion 6 above the floor or base of the well 5 preferably is from approximately half to two thirds of height h of the wall 4 above the floor of the well 5. It is advantageous for the upper edges of the side faces 11, 12 and 13 of element 6 to be rounded. The sections B and C of FIG. 4 show the radii of curvature of said edges 28, given the reference symbol 28 R in FIG. 1B and C.

FIG. 1 illustrates the simplest possible embodiment of the present invention. The die 3 is produced, formed or worked from a solid material. Its basic shape comprises a tub-like inner contour, with the height h of the peripheral wall 4, or the depth of the well 5, being dependent on the billet width. Usually, such a tub or die 3 comprises a continuous wall 4 of width s, which width does not have to be constant around the entire billet circumference. The tub portion is not fully stripped or devoid of the solid material; a truncated conical elevated central portion 6 is formed in the tub portion in accordance with the invention. In the simplest design, the conical central portion 6 comprises a rectangular horizontal cross-section shape. The well width A is dimensioned to be such that, additionally, it is possible to provide drainage bores 32 to prevent any "bumping" towards the side or in a downward direction. When the casting process starts, said bores 32 are closed in conventional manner.

The dimensions of the conical portion 6, walls 4 and well 5 are adjusted relative to one another in such a way that the volume of the well area of the die 3 to be filled corresponds to that of a conventional die. Then it is possible to conduct the casting process using dies of the present design but having the same volume or capacity as the prior art dies, for reducing stresses in the initial casting phase, such as using the $CO_2$ technology, the pulsed water technology or the turbo technology.

Figure 2C:
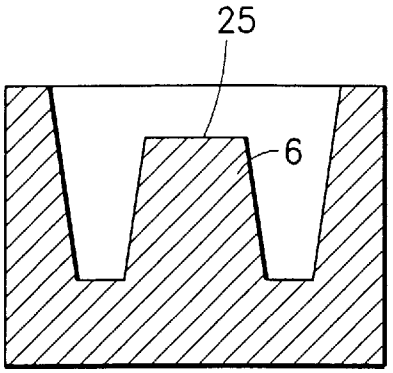
FIG. 2 illustrates a plan view A and cross-sections B and C of a die in accordance with another embodiment of the invention, having a roof-like, inclined upper end.
Figure 2B:
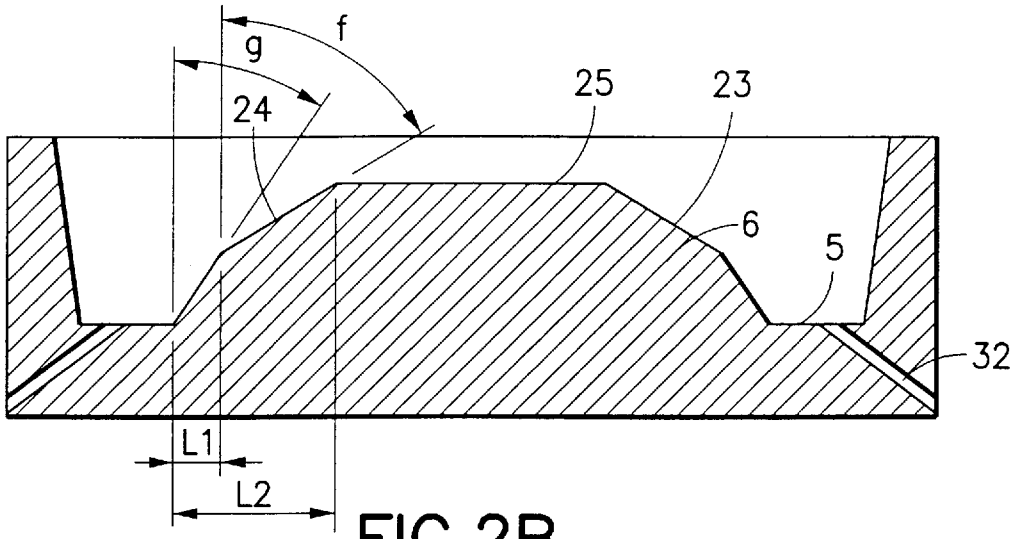
Figure 2A:
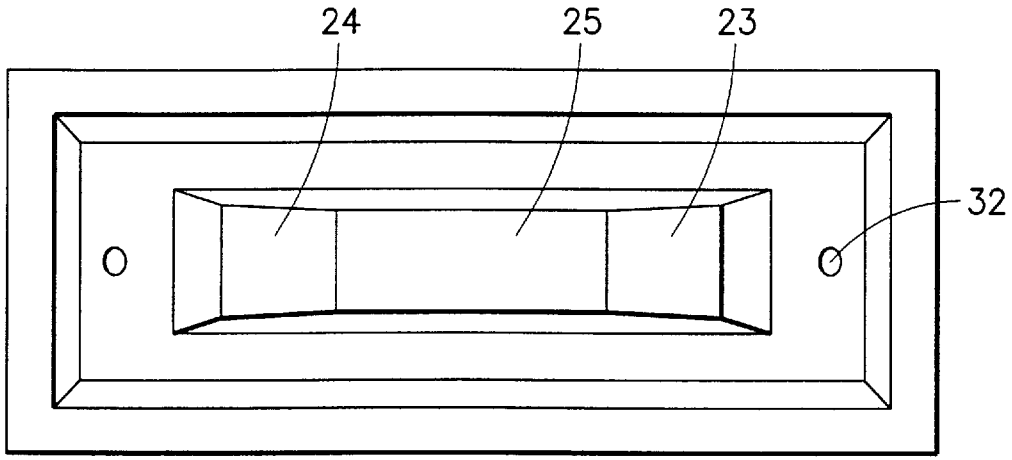

In FIG. 2, the roof plane of the central raised portion 6 is angled or faceted in the longitudinal direction of the die from the flat upper surface 25 towards the ends or narrower sides as inclined roof faces 23, 24 which, in a particularly advantageous way and with a planar metal supply inlet, ensure the formation of a stable surface layer or skin layer on the billet. The angle of inclination of the roof portions 23, 24 towards the narrower sides or ends of the rectangular die 3 is selected to be such that during and after deformation of the billet base, the melt, during the initial casting phase, does not flow directly against the surface layer formed on the flat upper surface 25.

To clarify the effects of the system in accordance with the invention, two examples are described below. In the first example, the dimensions of the billet are 600×200 mm so that the outer dimensions of the die also comprise the dimensions of 600×200 mm. In this case, the roof areas 23, 24 and 25 of the roof plane may have the following dimensions: $L_1$ equals approximately ⅛ of the maximum length of the conical section 6 and $L_2$ to approximately ¼ of the maximum length of the conical section 6, with the length of the conical section 6 in the base region amounting to 480 mm and in the flat roof region 25 to 285 mm. The thickness or width of a conically shaped raised portion 6 amounts to 70 mm in the upper region 25 and to 100 mm in the lower region of the cone base.

The second example uses a billet of size 1000×400 mm and a correspondingly dimensioned mould. The die comprises a conically shaped raised portion 6 whose length amounts to 870 mm in the lower region (base plane) and to 620 mm in the upper region 25. The thickness or width of the conically shaped raised portion 6 amounts to 95 mm in the upper region 25 and to 200 mm in the base region. These data refer to the die shapes shown in FIG. 2. The angles g and f shown in FIG. 2B, associated with the lengths $L_1$ and $L_2$ range between 30° and 600°. In the case of rounded edges, it is necessary to form the outer angles to provide the correct radius of curvature thereof.

Figure 3C:
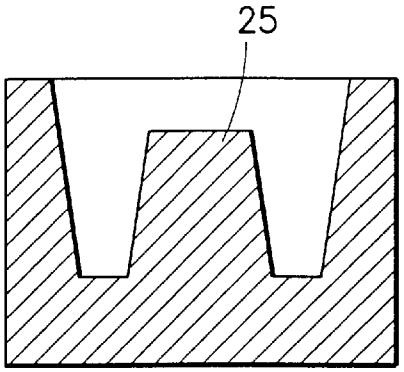
FIG. 3 illustrates a plan view A and cross-sections B and C of a die in accordance with another embodiment of the invention, having a raised portion with an elliptical plan area.
Figure 3B:
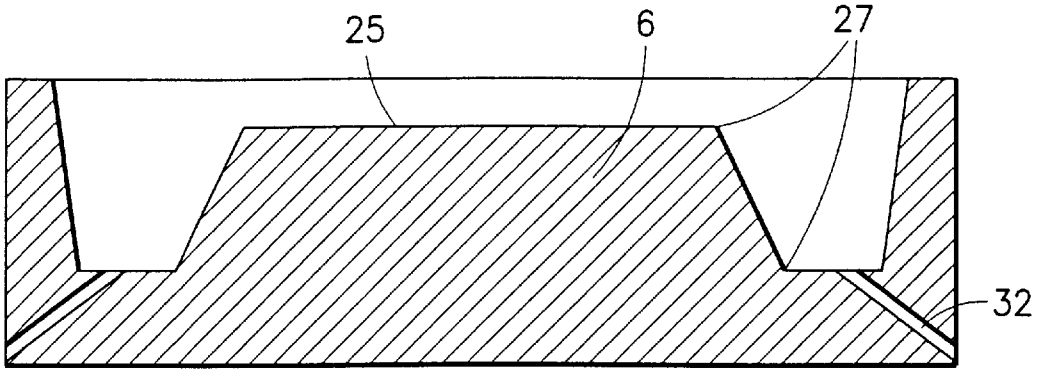
Figure 3A:
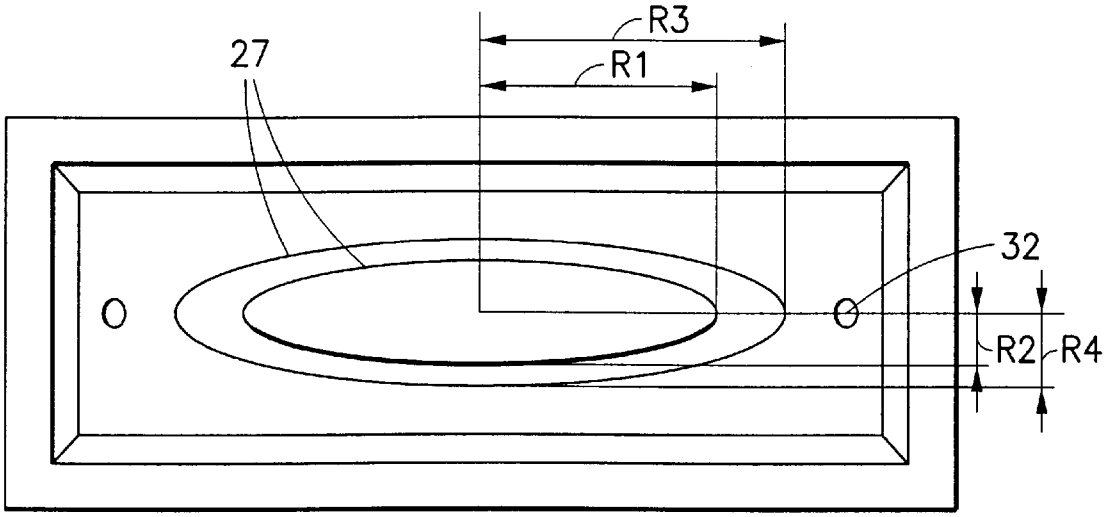

FIG. 3 shows a further variant of the die 3 in accordance with the present invention in which the raised portion 6 is elliptical at the flattened roof portion 25, and the base portion, in the longitudinal and transverse directions, as shown by elliptical peripheries 27 having the radii R1, R2, R3 and R4. With a radius R3 at the base end of the raised portion 6, the radius R1 amounts to approximately 70% of R3 and with a width R4 at the base end of the raised portion 6, R2 amounts to approximately 75% of R4. Conical portion 6 has elliptical roof and base peripheries 27.

Analogously to FIG. 1, the angles c, d and e of the embodiment according to FIG. 3 have to be selected to be such that the billet, when shrinking, retains a firm hold on the conical seat of the raised portion (6), but can easily be removed at the end of the casting process. If the angles c, d and e are too steep, i.e., if it exceeds 65° for examples, the billet slides upwardly on the conical portion 6 and does not retain its firm hold. If the angles c, d and e are too small, i.e., less than 25°, the billet clings to the conical portion 6 to such an extent that it can no longer be lifted off the die. The raised conical portion 6 with an elliptical plan area is advantageous in that a larger area may be provided for the optimum angle without the billet base shrinking too firmly onto the conical section 6 or losing its hold.

FIG. 4 shows a variant of the embodiment illustrated in FIG. 3 in that the end and side areas 28 of the raised elliptical portion 16 are rounded. As viewed from the base of the well 5, the angle x of the elliptical inclined side wall 15 increases continuously, thereby causing the formation of a draught. As compared to the variant shown in FIG. 3, the continuous casting system with the die as illustrated in FIG. 4 exhibits an even more advantageous operating behavior during the initial casting phase and at the end of the casting operation.

Figure 5C:
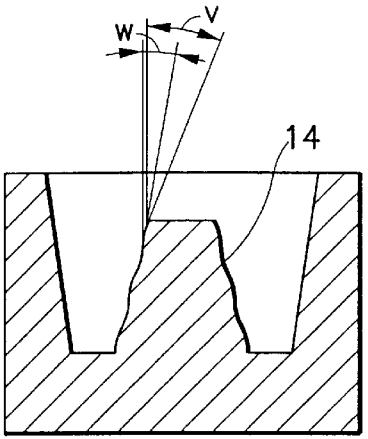
FIG. 5 illustrates a plan view A and cross-sections B and C of a die in accordance with another embodiment of the invention, having a rippled side face.
Figure 5B:
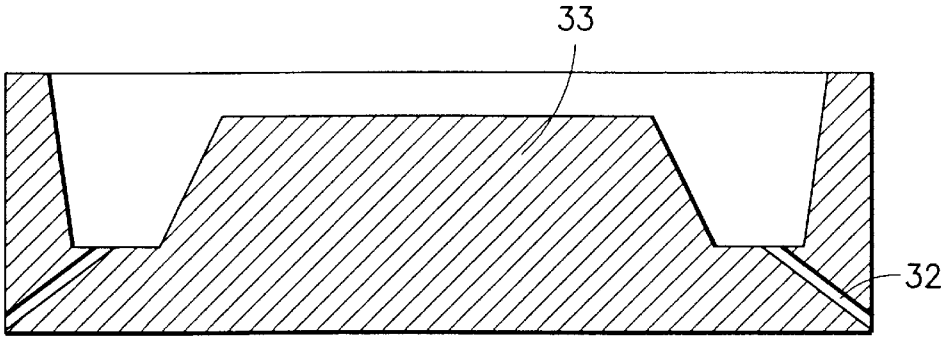
Figure 5A:
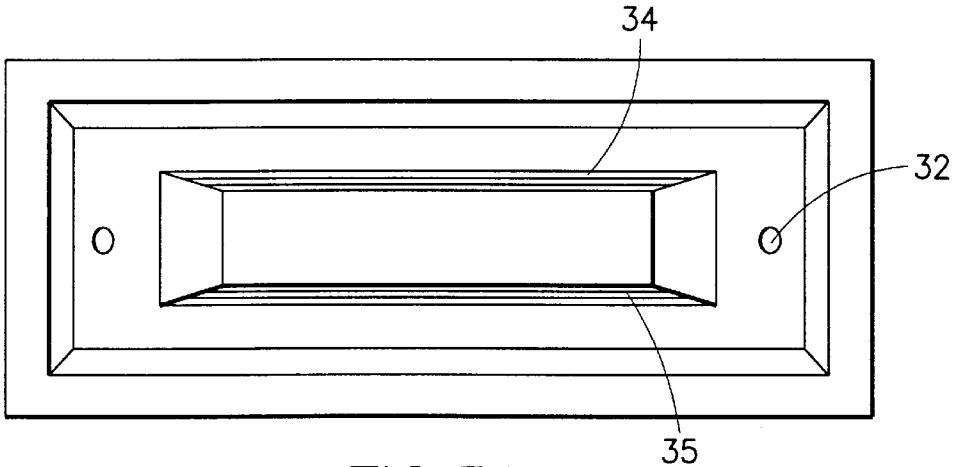

According to the embodiment illustrated in FIG. 5, the raised central portion 33 of the die comprises side faces 34, 35 having rippled surfaces. The horizontal ripples comprise alternating angles V, W, with one of the two angles being smaller and one greater than the optimum angle, as shown in FIG. 5C. As a result, the billet base is able to shrink or contract onto the conical side faces 34, 35 and at the same time slide upwardly. As a result, the billet retains a firm hold during the casting operation. After completion of the casting process, the contact area between the billet and rippled side faces 34, 35 is so small that the billet can be removed from the die 3 without having to apply any additional high forces.

If the melt is supplied to the mould too rapidly, or when casting alloys which tend to stick or when casting melts which are too hot, there is a risk of the surface of the raised conical central portion 6, 33 melting and of the billet base being welded to the side faces of the raised portion 6, 33. In accordance with the invention, this problem can be solved by applying heat-protective coatings or facings to the surface of the conical raised central portion 6, 33 or to parts thereof. By applying protective coatings or facings, the heat transfer from the melt to the raised portion may be influenced in such a way that the dissipation of the heat introduced into the conical raised central portion takes less time than the time needed for the conical raised portion to heat up and melt on to the billet. During the initial casting phase, before a surface layer or skin of the casting metal has formed on the raised portion, such coatings or facings protect the surface of the conical raised central portion 6, 33 from the incoming melt.

Figure 6C:
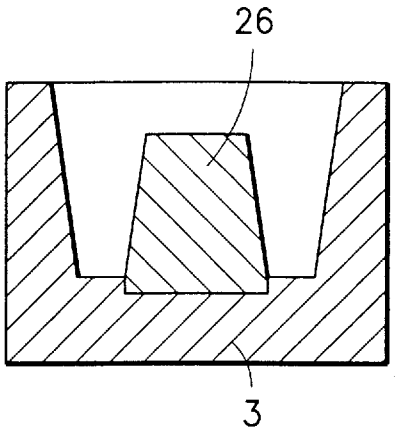
FIG. 6 illustrates a plan view A and cross-sections B and C of a die in accordance with another embodiment of the invention, having an insert secured within a floor recess.
Figure 6B:
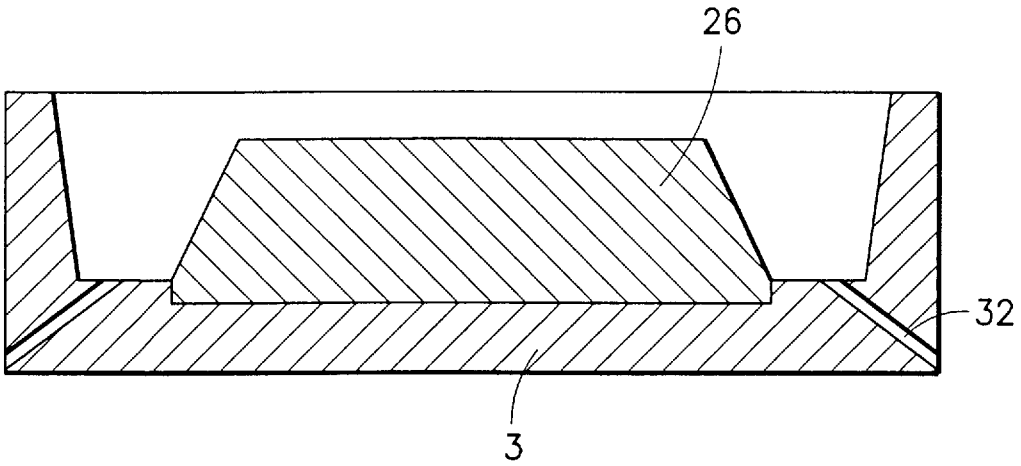
Figure 6A:
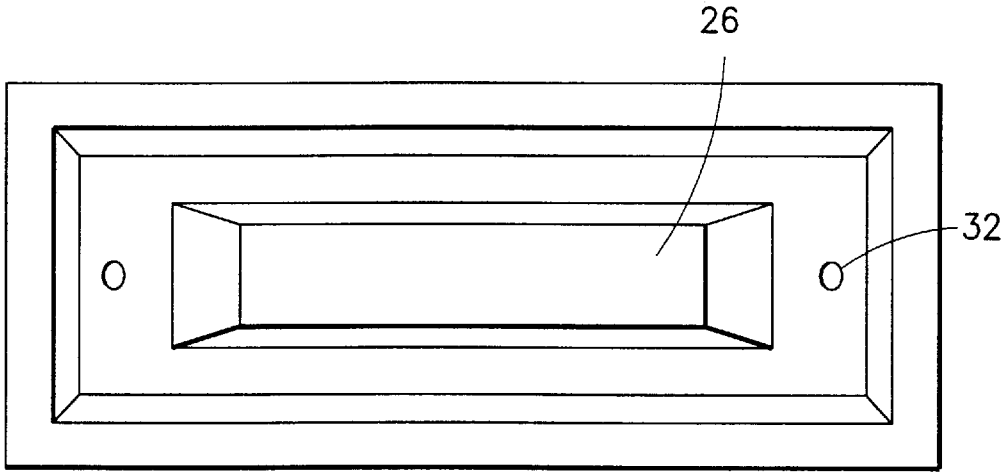

According to FIG. 6, a further solution for overcoming the heat problems as described consists in that the die 3 is not formed from a single solid block. The conical raised central portion is separately formed from a different metal, preferably from a copper alloy, and inserted as an element 26 into a recess in the floor of the die 3 in a form-fitting way. Additionally, the insert 26 may be bolted or shrunk into a central recess in the base of the die 3. With this design, the insert 26 is able to exert its full cooling effect during the initial casting phase because the raised copper alloy insert 26 is able to accommodate higher thermal loads than a die portion made of an aluminum alloy.

Figure 7C:
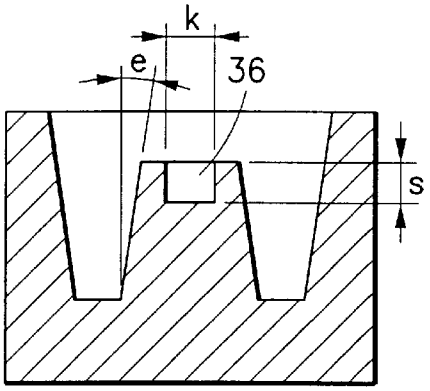
FIG. 7 illustrates a plan view A and cross-sections B and C of a die in accordance with another embodiment of the invention, with the upper end of the raised portion being provided with a guide slot or groove.
Figure 7B:
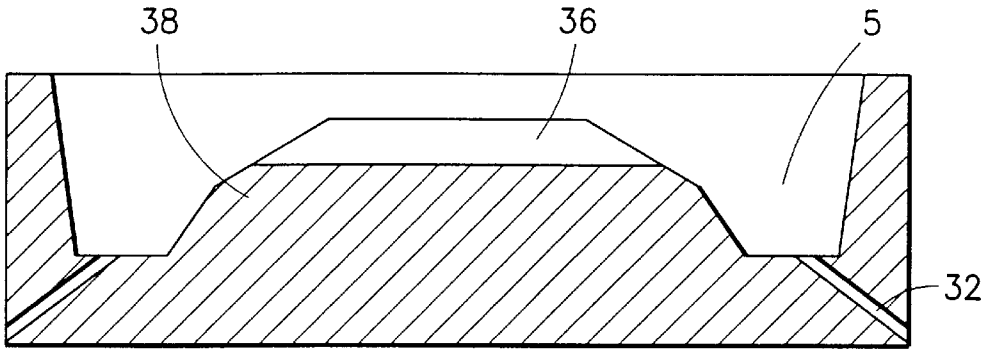
Figure 7A:
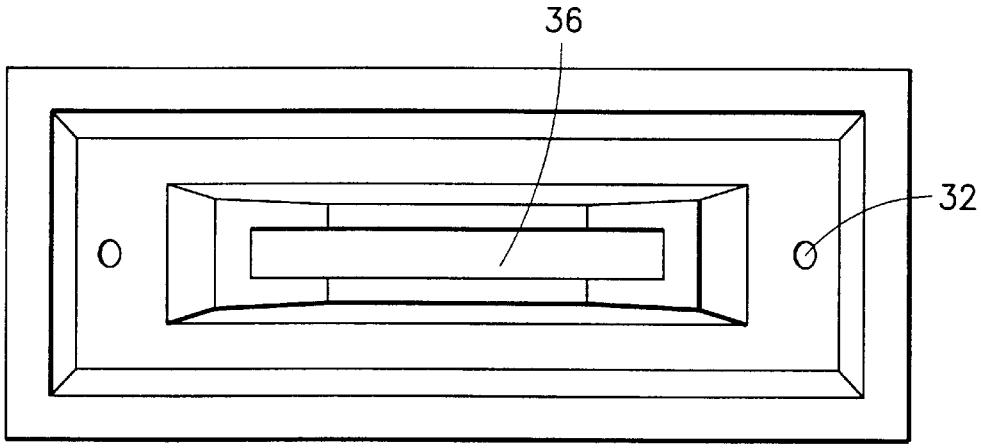

According to a further embodiment illustrated by FIG. 7, the die 3 is provided in the tub-like well 5, with a conical central raised portion 38 which is provided on its upper surface with a longitudinally extending guide or groove 36. The depth "S" of the groove 36 is such as to allow the billet base to slide and be guided upwardly on the conical raised portion 38 without disengaging from the groove 36. The width k of the groove 36 is such that it can easily be filled with metal melt, as a result of which the central underside of the billet base is formed with a fin or extension which is engaged within the groove 36.

If the angle e of the longer side faces of the conical raised portion 38 is greater than the optimum angle, the billet, by shrinking, is pushed upwards on the cone, and the billet may lift off at different rates on the two longer sides. In consequence, the billet may bend in the base region. The groove 36 ensures that the formed billet fin or extension is guided in such a way that, on both sides, it slides upwards on the conical section 38 at equal rates, thereby retaining a firm hold. In principle, the groove 36 may also be replaced by one or several slots, bores or by other guiding means.

Figure 8C:
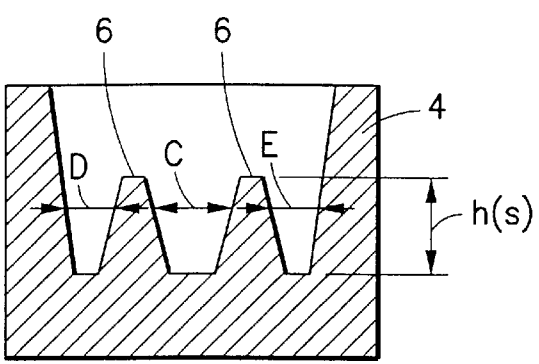
FIG. 8 illustrates a plan view A and cross-sections B and C of a die in accordance with another embodiment of the invention, having two raised portions extending in parallel.
Figure 8B:
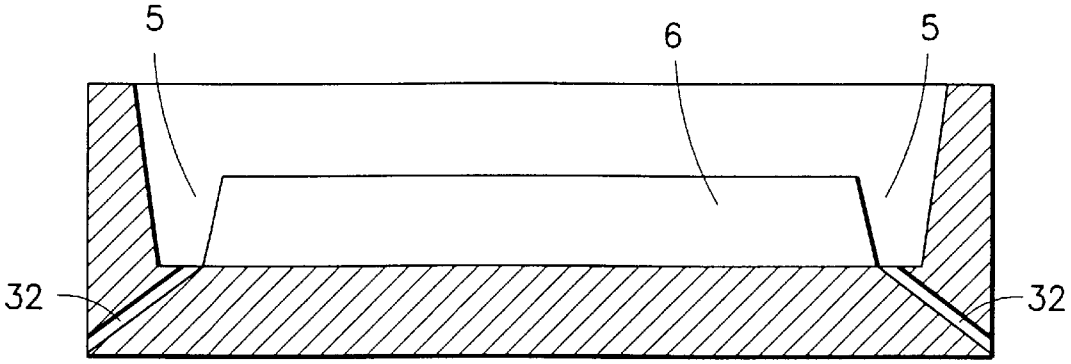
Figure 8A:
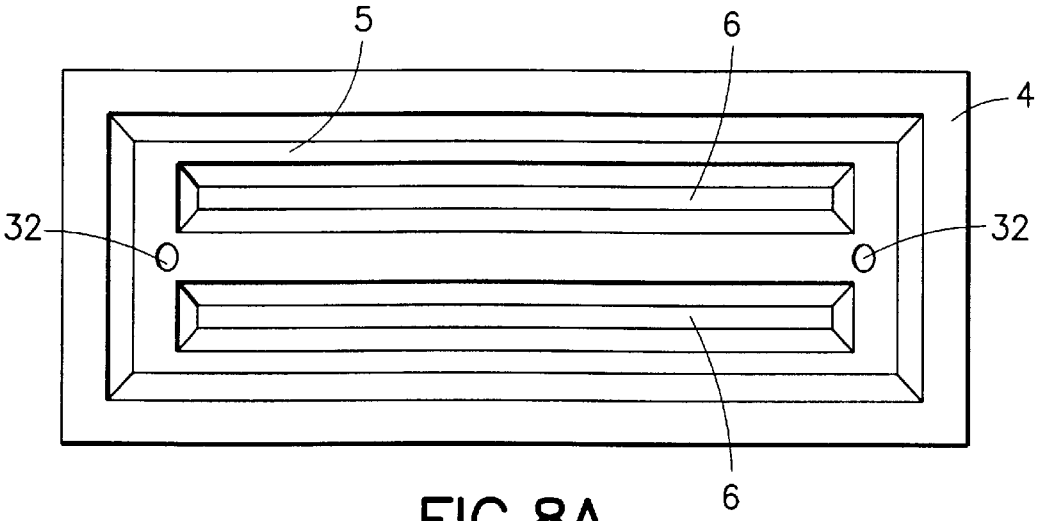

According to FIG. 8, a plurality of parallel raised portions 6 are arranged in the longitudinal direction of the well area 5 of the die 3. As compared to FIG. 1 showing a die with only one raised portion 6, the height h(s) shown in the design of FIG. 8C, be reduced so that the total volume enclosed by the continuous wall (4) is increased relative to the preceding designs. The melt capacity of the die 3 according to FIG. 8 is greater, especially for alloys which are difficult to cast.

Figure 9C:
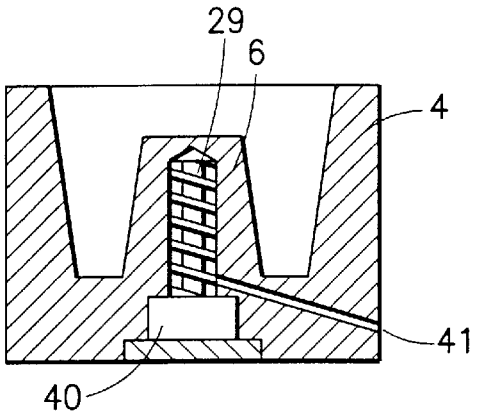
FIG. 9 illustrates a plan view A and cross-sections B and C of a die in accordance with another embodiment of the invention, having an internally-cooled raised portion.
Figure 9B:
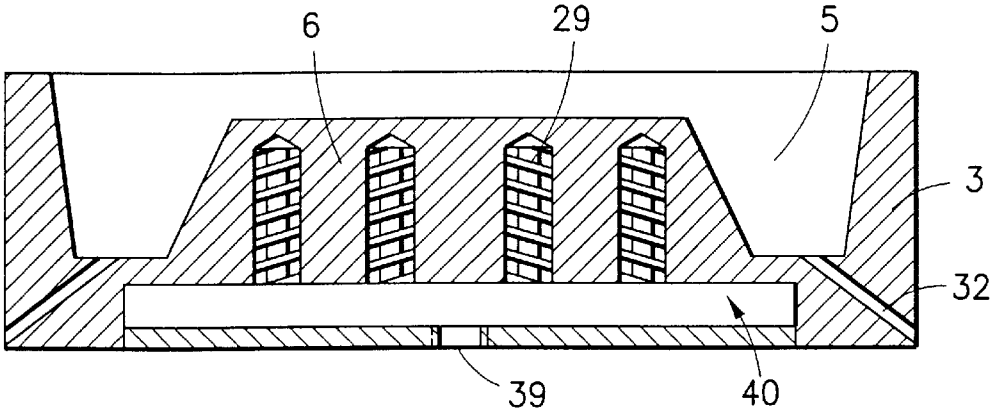
Figure 9A:
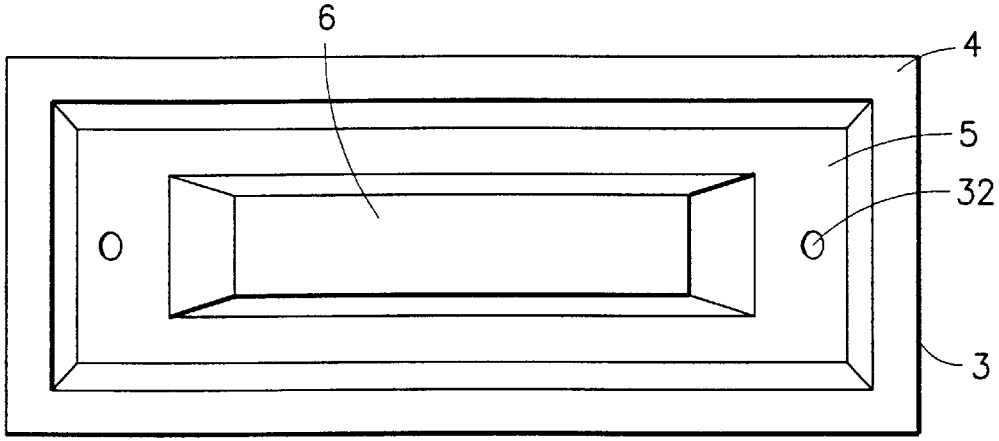

FIG. 9 shows a die 3 in accordance with the invention, comprising a plurality of internal cooling water bores 29 within the conical raised portion 6. The cooling medium is preferably water. By means of suitable inserts within bores 29, shown by FIG. 9B, the cooling medium is directed through a spiral passageway into those regions of the conically shaped raised portion which are subjected to particularly high loads. The water supply pipe 39 opens into a water chamber 40 where each cooling spiral passageway through a bore 29 is provided with a supply of the cooling medium. The water is drained by a pipe 41 directly out of each cooling spiral bore 29 through the wall of the die 3, as shown by FIG. 9C.

Figure 10C:
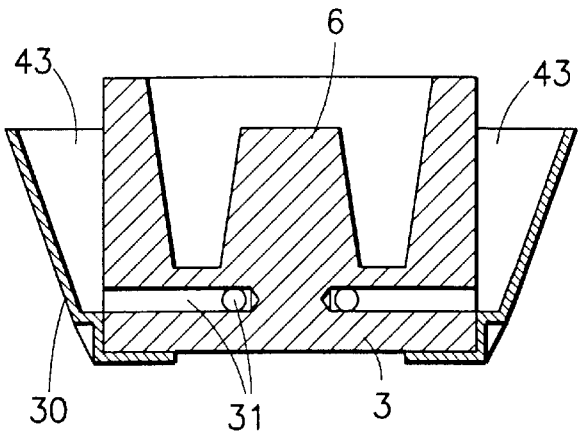
FIG. 10 illustrates a plan view A and cross-sections B and C of a die in accordance with another embodiment of the invention, having laterally attached water guiding plates opening to cooling bores within the bores.
Figure 10B:
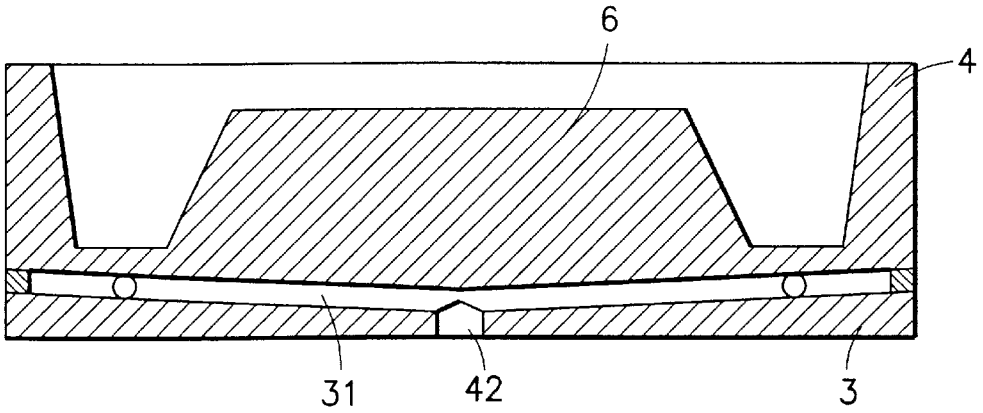
Figure 10A:
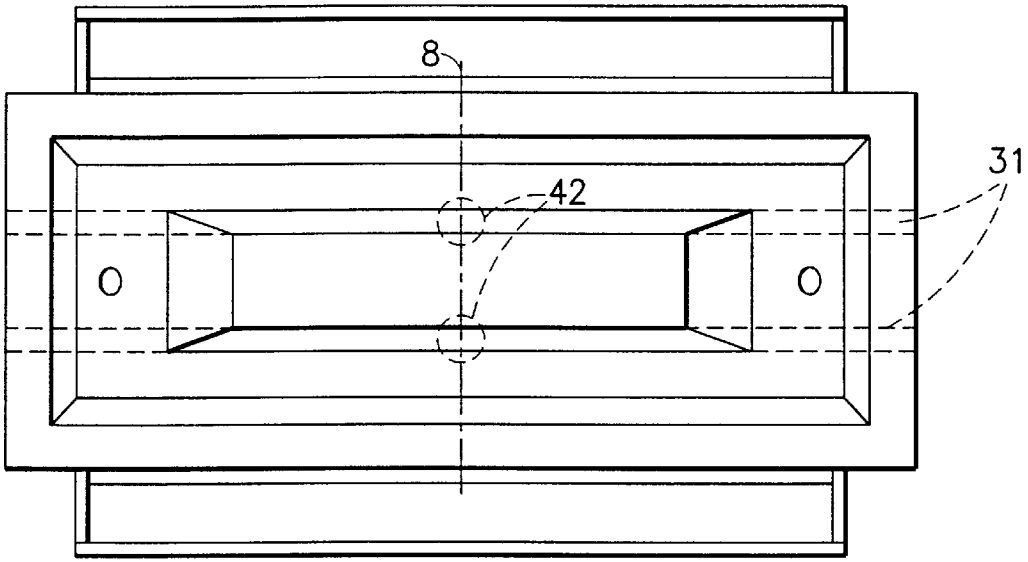

If the amount of cooling water supplied by the separate cooling water pipe 39 is inadequate, a secondary cooling system of the continuous casting apparatus, shown by FIG. 10, may also be used. Secondary cooling water is collected by a catching means 30 attached to the die 3 and guided through bores 31 into the die interior. The catching means 30 preferably consists of guiding plates secured directly to the underside of the die. The primary cooling water emerges from a pipe 42 arranged in the central axis 8 underneath the conical raised portion 6. The secondary cooling water is indicated by arrows 43. As cooling is required and advisable only while the die and mould are being filled and until the lower edge of the billet has entered the region of secondary cooling, it is sufficient for cooling to be effected entirely by the water provided by the catching means 30 of the secondary cooling system.

Figure 11C:
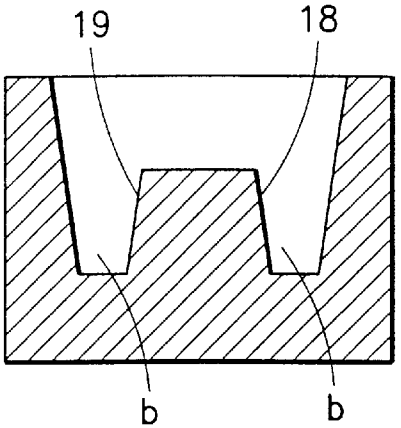
FIG. 11 illustrates a plan view A and cross-sections B and C of a die in accordance with another embodiment of the invention, having a longitudinal raised portion extending continuously from one narrow end wall face to the other.
Figure 11B:
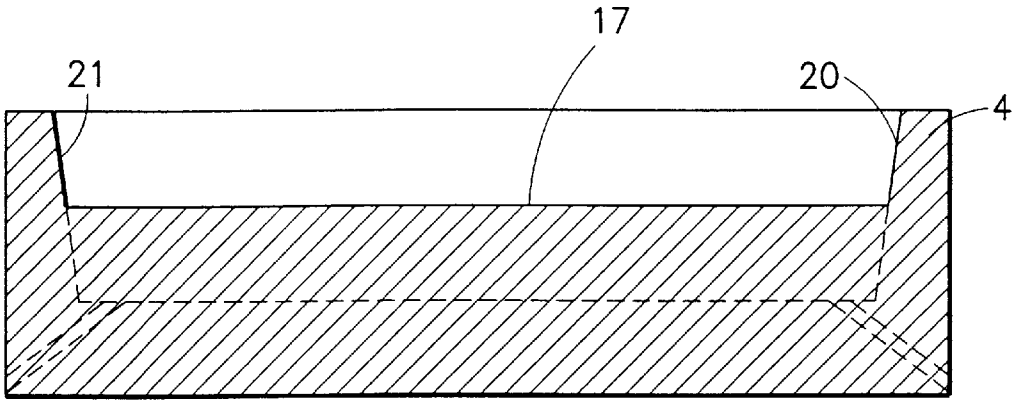
Figure 11A:
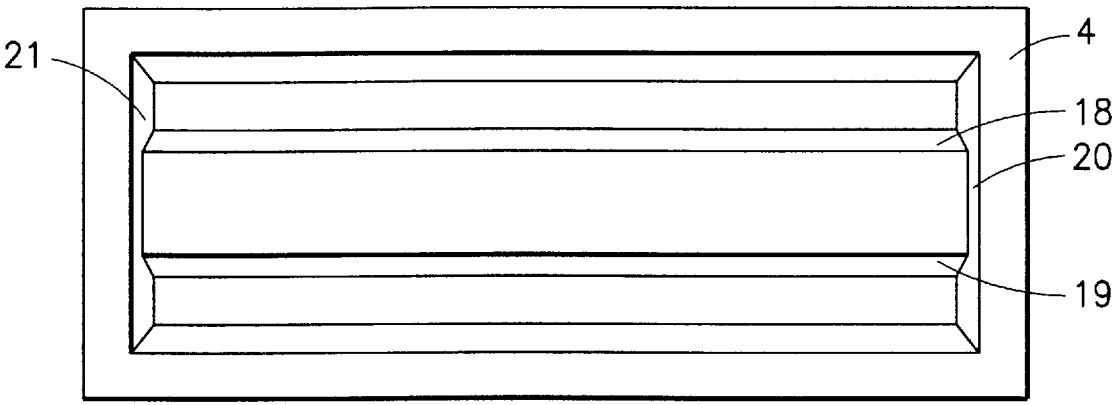

The embodiment according to FIG. 11 comprises a raised divider portion 17 extending in the longitudinal direction from the inner surfaces 20, 21 of the continuous wall 4 and comprising a trapezoidal cross-section. The inclined side faces 18, 19 of divider 17 result in relatively wide parallel longitudinal wells or channels b. This embodiment is preferably used for alloys which are easy to cast, such as pure aluminum.

Figure 12:
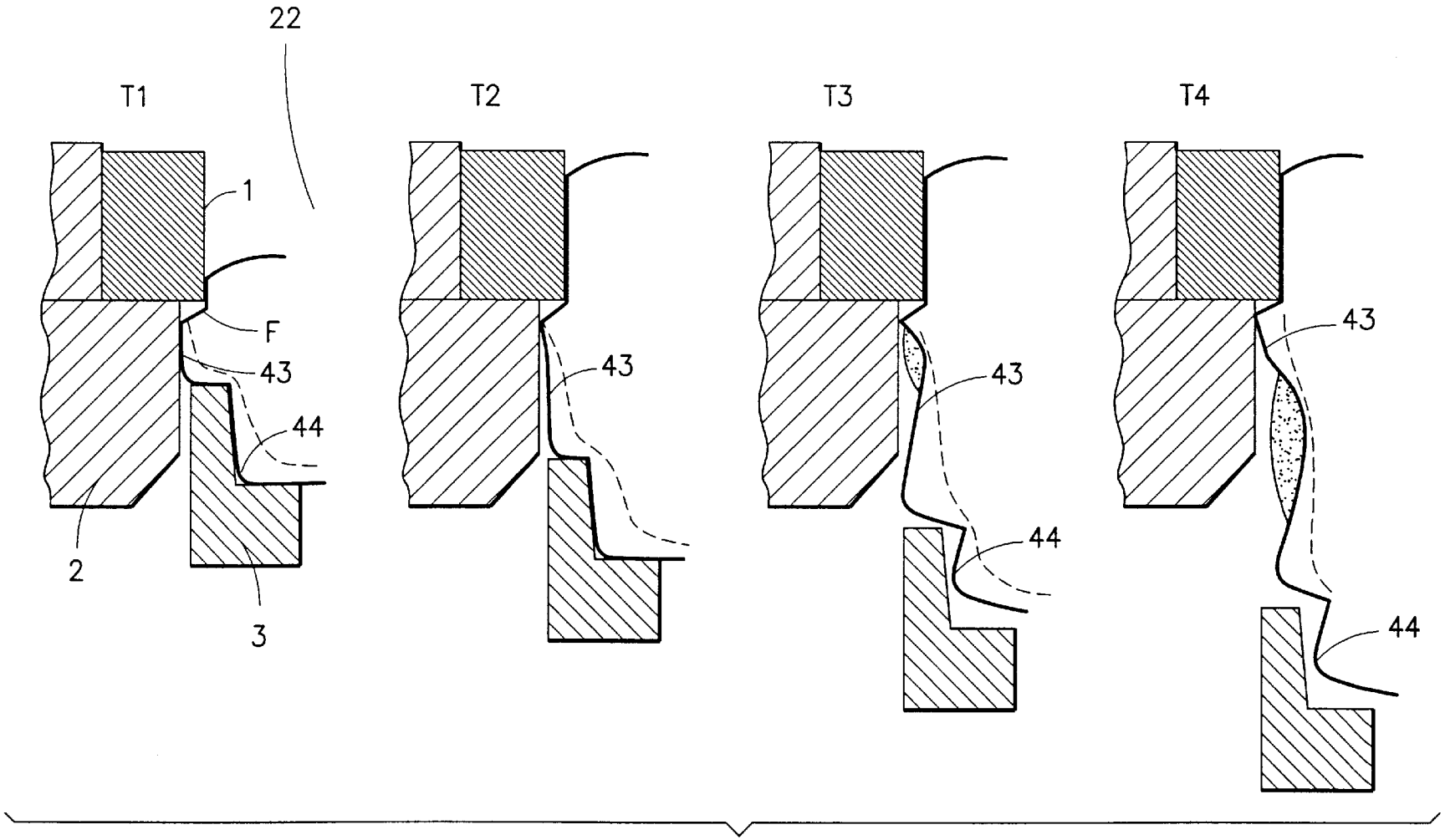
FIG. 12 PRIOR ART
FIG. 12 is a diagrammatic illustration of the sequential billet deformation which occurs over time during casting in a conventional continuous billet casting apparatus.

FIG. 12 diagrammatically illustrates the time-sequence behavior of the surface layer of the casting or billet in the region of the narrow sides of a continuous casting apparatus according to the present invention. The times are indicated by T1–T4, and the deformation in the billet base 44 is also shown. Reference number 1 refers to a hot top shaping attachment with an overhang F. The die 3 is present within and encloses the bottom of the annular cavity of the mould 2, and the filling process begins at T1. At the point in time T2, the surface layer 43 of the billet is fully formed and at T3, the billet buckles at 43 and 44 due to shrinking. Separations may occur in the dotted regions.

Figure 13:
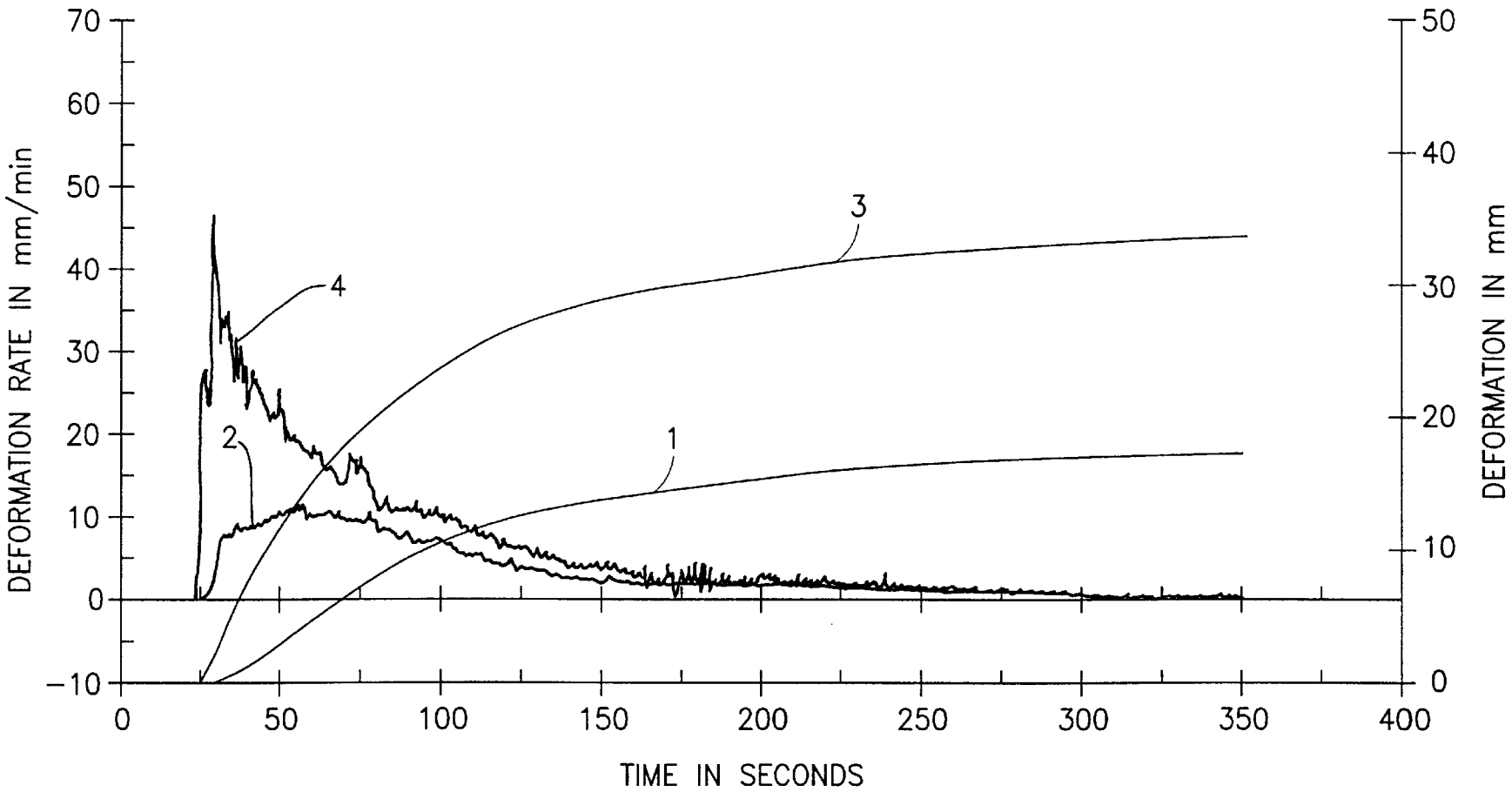
FIG. 13 is a graph illustrating the differences in degree and rate between standard billet base deformation and deformation in accordance with the present invention.

FIG. 13, illustrates, for a die in accordance with the invention having the dimensions of 1100×400 mm, the extent by which the rate of billet base deformation has been reduced (lines 1 and 2) as compared to a conventional die (lines 3 and 4), using the same casting conditions. The conventional die had a depth of 60 mm, whereas the die according to FIG. 1 of the present invention has a depth of 160 mm and a conical section of 100 mm height. Deformation was recorded during the initial casting phase by linear displacement transducers, and the measuring points were located in the centers of the shorter or narrower sides, and the value shown in each case is the mean value of the values recorded on the left and right (or at the front and rear).

At the end of the initial casting phase, the amount of deformation on each side had been reduced from approximately 33 mm to approximately 18 mm. As can be seen from the curves 1 and 2 of the deformation speed, i.e. the speed at which the narrower sides lift off the die, the deformation speed, especially at the onset of the deformation process, is reduced in the case of the die having the conical section. In the case of the conventional die, this speed shown by curves 3 and 4 amounts to approximately 50 mm/min on each side and equals the casting speed. If the extent of deformation is not the same on the two narrower sides, one of the narrower sides is able to move upwards into the mould against the casting direction. In the case of hot top billet moulds, this may lead to the hot top being damaged. As a result of the die with the conical element, the maximum deformation speed is reduced to less than 20 mm/min. Even with deformation on one side only, the resulting deformation speed of the other side would be less than 40 mm/min and thus shorter than the lower speed.

The reduced amount of deformation also results in a narrower gap between the mould and die. If this gap is permitted to fill with water, the water evaporates and the billet is able to start "dancing" (bumping) on the die. Attempts are made to counter this effect by providing drainage bores 32 in the well portions 5 in the region of the narrower sides in the die. When casting starts, said bores are closed by aluminum plugs. The plugs are cast into the underside of the billet, and as a result of the deformation of the billet base, they are pulled out of the bores. Before the water in the gap causes the billet to bump, it is drained off through the bores 32. Because there is less billet deformation in the case of a die 3 with a conical portion 6 less water flows into the gap and in consequence, fewer drainage bores are required.

FIG. 12 illustrates diagrammatically how the surface layer 43 of the billet, in the region of the narrower sides of a conventional die, lifts off the running face of the mould 2 during the deformation process by top shaping attachment and causes a gap, with heat dissipation from the surface layer being reduced considerably. The resulting heat build-up may cause separation and even complete melting of the surface layer. Because of the reduction in deformation between the inner surface of the wall 4 and the tapered surface of the conical element 6 of the present inventive dies 3, said gap becomes smaller. Furthermore, the reduction in deformation speed results in a higher absolute lowering speed of the surface layer in this region, and the critical region where fracture is likely to occur is lowered more quickly from the mould into the region of secondary cooling. In operation, the tendency to form separations is clearly reduced and so is the formation of icicles.

Figure 14:
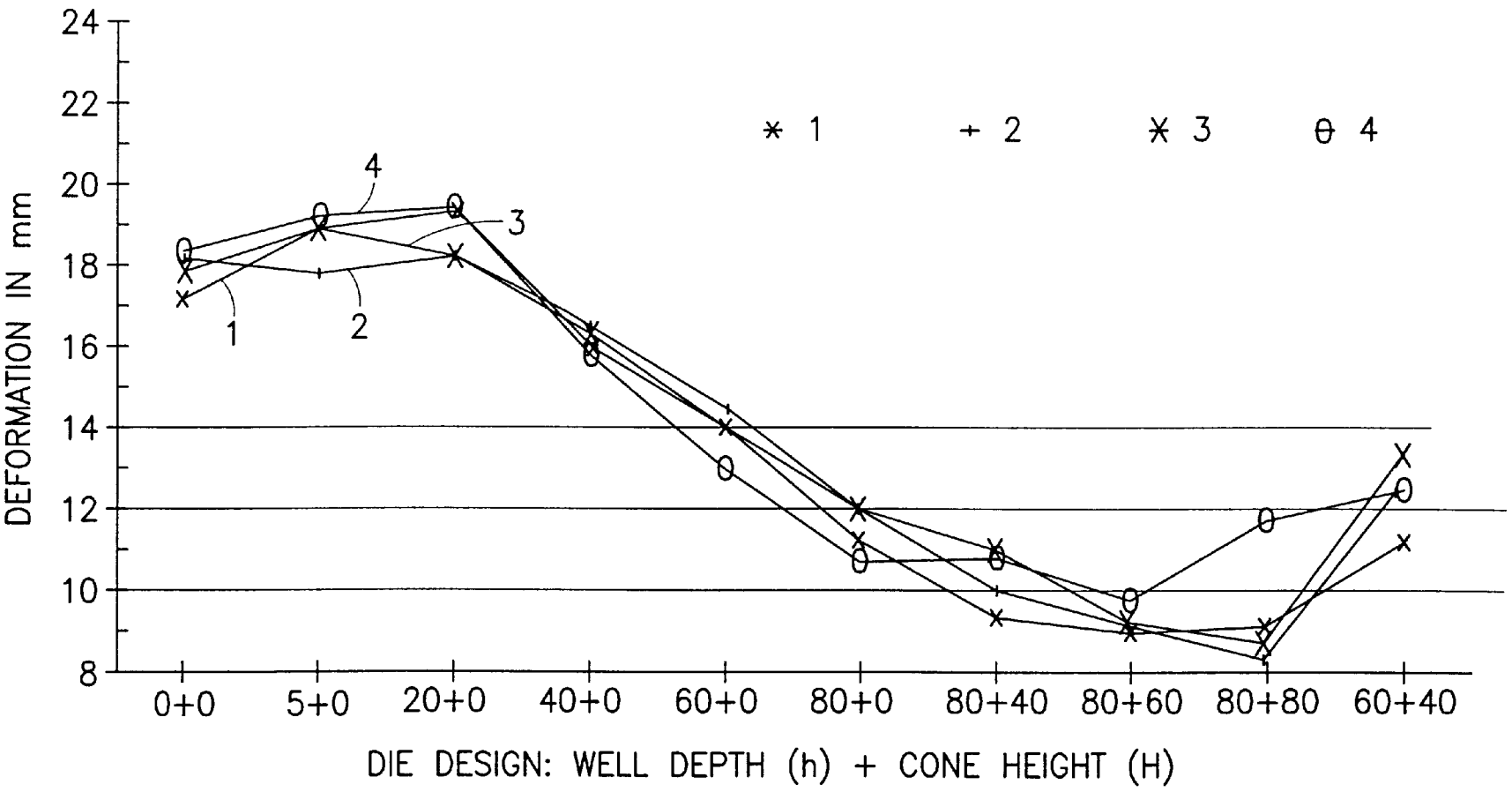
FIG. 14 is a graph illustrating the differences between standard deformation and deformation in accordance with the invention, with dies having different well depths and cone heights.
Figure 15:
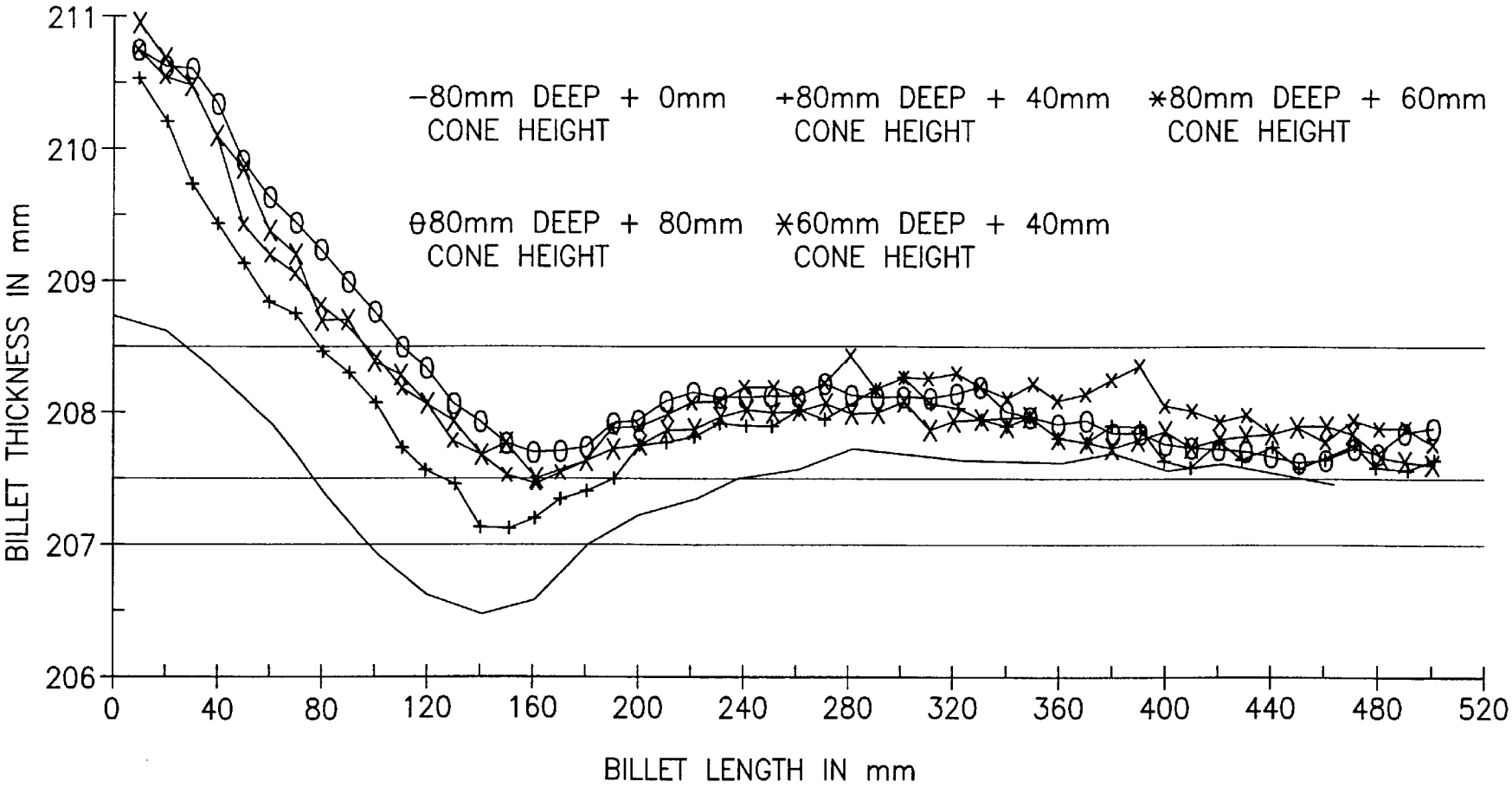
FIG. 15 is a graph illustrating deviations in the billet thickness as a function of the cast length, comparing standard die dimensions and die dimensions in accordance with the present invention.

FIG. 14 compares the results of tests carried out to reduce the amount of deformation by using a die 3 with a conical element 6 and dimensions of 600×200 mm with the results using a conventional die. The comparison relates to a conventional die with different uniform tub depths (h) ranging between 0 mm and 80 mm and dies 3 in accordance with the invention, having cones heights (H) of 40 mm, 60 mm and 80 mm, with a well depth (h) of 80 mm, as well as a further die 3 in accordance with the invention with a well depth h of 60 mm and a conical section of 40 mm height H. The initial casting conditions were the same in all tests, in particular, the same casting speed and quantities of cooling water were used. In the case of the conventional die it can be seen that from a tub depth (h) of 20 mm, the amount of deformation decreases as the depth increases, from values in excess of 18 mm to values around 12 mm with a tub depth (h) of 80 mm. By providing the conical element 6, deformation can be reduced further. An increased cone height (H) results in additional stiffening of the billet base, i.e in a further reduction in deformation. With a cone height (H) of 80 mm, deformation amounts to only 8 to 9 mm. Even with a die of a depth of 60 mm, in a direct comparison, deformation is additionally reduced by approximately 1 to 2 mm as a result of the central conical element. Merely deepening the tub without using a conical element 6 leads to an unfavorable shrinkage behavior of the billet in the base region, as shown in FIG. 15 which shows the billet thickness in the centers of the longer sides as a function of the casting time; the above-mentioned tests were carried out using dies 3 of a depth of 80 mm as well as dies with conical elements. As a result of the large amount of heat building up in the die without a conical element 6, a deeper sump occurs during the initial casting phase, which causes an extraordinarily high degree of shrinking after thickening of the billet base.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a continuous casting apparatus for billets to be rolled, comprising a mould having a mould cavity of rectangular cross-section, a hot top shaping attachment at the entrance of the mould cavity, and a starter block which closes the lower end of the mould cavity, and a starter block which closes the lower end of the mould cavity in the starting position and which receives a metal melt from the shaping attachment directed in the vertical direction into the starter block, characterized by said starter block comprising a vertically-movable block having a rectangular horizontal cross-section corresponding to that of the mould cavity and being provided with a substantially tub-shaped well area having a floor enclosed by a continuous peripheral wall having a downwardly and inwardly inclined inner surface, and containing at least one raised portion arranged symmetrically relative to the central axes of the starter block, the outer surfaces of the raised portion being inclined to said floor downwardly towards the inclined surface of the continuous wall to form said well area, said raised portion having a height above the floor of the well area which is equal to from approximately ½ to ⅔ of the height of said peripheral wall above the floor of the well area.

2. A continuous casting apparatus according to claim 1, in which the well area is formed between the inclined inner surfaces of the peripheral wall and the inclined outer surfaces of the raised portion and has a V-shaped cross-section.

3. A continuous casting apparatus according to claim 2 in which the inner surfaces of the continuous wall are inclined at an angle up to about 30° relative to vertical, and the outer surfaces of the raised portion are inclined at an angle of 25° to 65° relative to vertical.

4. A continuous casting apparatus according to claim 1 in which the raised portion is approximately rectangular in horizontal cross-section, and the well area between the peripheral wall and the raised portion(s) has a tub volume or capacity sufficient for receiving molten metal and for forming a surface layer of the billet being cast.

5. A continuous casting apparatus according to claim 4 in which the horizontal cross-section of the starter block corresponds in dimensions to the cross-section of the mould cavity.

6. A continuous casting apparatus according to claim 1 in which the inclined inner surfaces of the peripheral wall of the starter block compensate for the change in cross-section which occurs when the billet being cast shrinks, causing the billet to unseat from the starter block.

7. A continuous casting apparatus according to claim 1 in which the raised portion of the starter block is rectangular in horizontal cross-section, the angle of the inclined side faces on the longer sides of the raised portion ranging between about 30° and 36° relative to vertical, and the angle of the inclined end faces on the narrower sides ranging between about 30° and 60° relative to vertical.

8. A continuous casting apparatus according to claim 1 in which the peripheral wall comprises opposed longer sides and opposed narrower sides, and the distance between the inner surfaces of the peripheral wall of the starter block and the outer surfaces of the raised portion, at the base of the well area, ranges between 100 mm and 150 mm on the narrower sides and between 30 mm and 100 mm on the longer sides.

9. A continuous casting apparatus according to claim 1 in which at least one pair of opposed outer surfaces of the raised portion of the starter block comprise horizontally-rippled surfaces.

10. A continuous casting apparatus according to claim 9 in which the rippled surfaces comprise stepped ripples having alternating angles.

11. A continuous casting apparatus according to claim 1 in which angle of inclination of the outer surfaces of the raised portion, relative to vertical, increases gradually upwardly from the base of the well area to form rounded or curved surfaces.

12. A continuous casting apparatus according to claim 1 in which outer surface of the raised portion is elliptical in horizontal cross-section.

13. A continuous casting apparatus according to claim 1 in which that the upper edge of the peripheral wall has a width ranging between 5 mm and 40 mm.

14. A continuous casting apparatus according to claim 1 in which, in the longitudinal direction, the ratio between the height of the peripheral wall of the starter block and the maximum width of the well area ranges between 1:2 and 1:3.

15. A continuous casting apparatus according to claim 1 in which the upper surface of the raised portion comprises facet areas which are inclined towards the narrow peripheral walls of the starter block.

16. A continuous casting apparatus according to claim 15 in which that the central region of the upper surface of the raised portion is horizontally level, and the facet areas taper therefrom towards the well area via inclined facet areas.

17. A continuous casting apparatus according to claim 1 in which the upper surface of the raised portion comprises one or more bores or grooves for receiving casting metal and forming an integrated extension of the solidified casting.

18. A continuous casting apparatus according to claim 1 in which the raised portion is elliptical in horizontal cross-section.

19. A continuous casting apparatus according to claim 1 in which the outer surface of the raised portion is curved or rounded from the well area upwardly to the upper surface thereof.

20. A continuous casting apparatus according to claim 1 in which the central raised portion comprises a material having a higher thermal conductivity and a higher temperature resistance than the remainder of the starter block.

21. A continuous casting apparatus according to claim 20 in which said material consists of a copper alloy insert.

22. A continuous casting apparatus according to claim 1 in which, from the bottom of the well area up to the top of the raised portion, the outer surface of the raised portion is curved and comprises a curvature radius smaller than about 5 mm.

23. A continuous casting apparatus according to claim 1 in which the raised portion of the starter block comprises at least one internal passageway for receiving coolant.

24. A continuous casting apparatus according to claim 1 in which the starter block comprises means for collecting cooling water flowing out of the mould, and means for guiding said water into cooling passages within the starter block.

25. A continuous casting apparatus according to claim 1 in which the bottom of the well area comprises water drainage bores.

26. A continuous casting apparatus according to claim 1 comprising a plurality of raised portions which extend parallel in the longitudinal direction of the starter block, the spacing between the parallel raised portions being greater than their spacing from the peripheral wall of the starter block, the well area having drainage bores arranged between the parallel raised portions at the narrow ends thereof.

27. A continuous casting apparatus according to claim 1 in which the hot top shaping attachment consists of a hot top element having an overhang which projects into the mould cavity.

* * * * *